US005320425A

United States Patent [19]

Stephenson et al.

[11] Patent Number: 5,320,425

[45] Date of Patent: Jun. 14, 1994

[54] CEMENT MIXING SYSTEM SIMULATOR AND SIMULATION METHOD

[75] Inventors: Stanley V. Stephenson; Charles D. Donaghe; Herbert J. Horinek; Karl W. Blanchard, all of Duncan, Okla.; Neil A. Pritchard, Rijnsburg; Jerry N. Browning, Noorewijkerhout, both of Netherlands; John Hanton, Dyce, Scotland

[73] Assignee: Halliburton Company, Duncan, Okla.

[21] Appl. No.: 100,890

[22] Filed: Aug. 2, 1993

[51] Int. Cl.[5] ..... B28C 5/00

[52] U.S. Cl. ..... 366/1; 209/1; 364/502; 366/2; 366/142; 366/143

[58] Field of Search ..... 366/1, 2, 3, 5, 6, 8, 366/10, 11, 14, 17, 348, 349, 140, 142, 143; 364/502; 209/1, 132, 133

[56] References Cited

U.S. PATENT DOCUMENTS

| | | | |
|---|---|---|---|
| 4,114,193 | 9/1978 | Hudelmaier | 366/2 |
| 4,916,631 | 4/1990 | Crain | 364/502 |
| 5,113,350 | 5/1992 | Sargent | 364/502 |
| 5,160,439 | 11/1992 | Dobrez | 364/502 |

*Primary Examiner*—Robert W. Jenkins
*Attorney, Agent, or Firm*—Stephen R. Christian; E. Harrison Gilbert, III

[57] ABSTRACT

A cement mixing and pumping simulator comprises actual and virtual equipment. In response to an operator controlling this equipment, signals representing operating characteristics of a cement mixing system realistically represented by the actual and virtual equipment are generated. These signals are communicated for displaying the operating characteristics to the operator so that the operator obtains real-time responses to the operator's control of the actual and virtual equipment. A method of simulating operation of a cement mixing system comprises: operating, at a master control location within actual equipment of the cement mixing system, at least one actual control device of the cement mixing system; operating, at the respective location of each, at least one of the actual equipment located away from the master control location; determining characteristics of material flow through the cement mixing system in response to the operation of the at least one actual control device and the at least one actual equipment without actually flowing material through the cement mixing system; and displaying the determined characteristics in real time with the operating and determining steps. This method preferably further comprises recording data identifying a performance evaluation of an operator in response to a comparison between at least one of the determined material flow characteristics and a corresponding predetermined characteristic.

20 Claims, 6 Drawing Sheets

CEMENT MIXING SYSTEM SIMULATOR AND SIMULATION METHOD

BACKGROUND OF THE INVENTION

This invention relates generally to a cement mixing and pumping simulator and a method of simulating operation of a cement mixing system. In a particular aspect, the cement mixing system includes either or both of an assembly of actual cement mixing equipment and an assembly of actual steady flow separator equipment; however, representations of realistic responses to actual operator control are generated without actually flowing material in the system.

During the creation of an oil or gas well, a cement slurry containing a mixture of water, cement and other materials typically needs to be made at the well site prior to being pumped into the well such as for cementing a tubular casing or liner in the wellbore. The slurry usually needs to have one or more specific characteristics, such as a desired density. Although the cement mixing process used at oil or gas well sites has been automated to a certain extent to obtain more readily any such desired characteristics, it still requires a skilled human operator to ensure that the process is carried out in accordance with a predetermined plan. The operator should be skilled enough to do this even when malfunctions or deviations occur.

One way to obtain skilled operators is to have them learn on the job. Although this may be necessary in some instances, it is not preferred because of the obvious risk that the operator might perform poorly and damage the well. This can result in wasted material and money, and it can also result in injury to personnel and damage to equipment. Furthermore, on-the-job training is a slow process because the operator cannot immediately repeat or try another cement mixing process at an actual well site. Another shortcoming of on-the-job training is that it is difficult to evaluate the operator because sufficient data defining the operator's performance is typically not available.

An enhanced training process is for an operator-trainee to use a simulator or simulation method. This type of training does not jeopardize an actual well, and it allows the operator to work through multiple cementing jobs and conditions in a relatively short period of time. Although there are cement mixing simulators and simulation methods, these require that actual materials and complete cement mixing systems be used. These have disadvantages such as being expensive since actual materials and complete systems are used and such as necessitating disposal of the materials which are created but which are not actually used in cementing in a well. These simulators can also be relatively unsafe because they actually run equipment, such as high pressure pumps, that can malfunction or be improperly operated whereby hazardous situations can arise.

In view of at least the aforementioned shortcomings of these prior training techniques, there is the need for a cement mixing system simulator and simulation method that can readily train cement mixing system operators to be able to handle various well conditions and unexpected problems, including equipment failures. There is the need for such simulator and method to generate and store data by which to evaluate the operator's performance; this is particularly important today as customers sometimes require compliance with quality improvement standards such as those of the International Organization for Standardization (ISO). Such a simulator and method should not require the use of actual materials so that the materials and money are not wasted and so that there is no disposal problem. Such a simulator and method should also not require at least some of the actual equipment that might create hazardous situations if it malfunctioned or was improperly operated. Satisfying this last-mentioned need would improve safety to both personnel and equipment. Such simulator and simulation method should also reinforce good operating procedures so that maintenance costs of actual field equipment can be reduced due to improved handling of it by trained operators. As well as meeting the aforementioned needs, the simulator and method should be flexible and provide a realistic environment so that an operator can have varied substantive training while also becoming accustomed to the appearance, placement, feel and operation of an actual cement mixing system.

SUMMARY OF THE INVENTION

The present invention overcomes the above-noted and other shortcomings of the prior art and meets the aforementioned needs by providing a novel and improved cement mixing and pumping simulator and a method of simulating operation of a cement mixing system. Advantages of the present invention include: (1) improving job quality by training operators in a realistic environment to handle various well conditions and unexpected problems, such as equipment malfunctions; (2) generating and recording operator performance evaluation data; (3) training without requiring actual materials so that materials and money are not wasted and disposal problems are not encountered; (4) training without requiring a complete operational cement mixing system so that personnel and equipment are not exposed to hazards that can arise during actual equipment operation (i.e., an operator-trainee can make a mistake on the simulator without risk of personal injury or equipment damage); and (5) reducing maintenance costs for actual field equipment by reinforcing good operating procedures.

In one aspect, the present invention provides a cement mixing and pumping simulator, comprising: actual cement mixing equipment disposed in a realistic representation of a cement mixing system used in the field for mixing cement for an oil or gas well; virtual cement mixing equipment means for representing actual operator-actuatable equipment of the cement mixing system, the virtual cement mixing equipment means disposed with the actual cement mixing equipment so that the virtual cement mixing equipment means is physically operable by an operator training on the simulator; virtual pumping equipment means for representing actual pumping equipment of the cement mixing system; and means, responsive to the operator controlling the actual cement mixing equipment and the virtual cement mixing equipment means and responsive to the virtual pumping equipment means, for generating signals representing operating characteristics of the cement mixing system and for communicating the signals to the actual cement mixing equipment to display to the operator the operating characteristics represented by the signals so that the operator obtains real-time responses to the operator's control of the actual cement mixing equipment and the virtual cement mixing equipment means. This simulator preferably further comprises means for generating and recording data identified with the operator and related to a comparison between at least one of the operating characteristics displayed to the operator and a predetermined response for the same at least one operating characteristic.

In another aspect, the present invention provides a method of simulating operation of a cement mixing system, comprising: operating, at a master control location within actual equipment of a cement mixing system, at least one control device of the cement mixing system; operating, at the respective location of each, at least one of the actual equipment located away from the master control location; determining characteristics of material flow through the cement mixing system in response to the operation of the at least one control device and the at least one actual equipment without actually flowing material through the cement mixing system; and displaying the determined characteristics in real time with the operating and determining steps. This method preferably further comprises recording data identifying a performance evaluation of an operator in response to a comparison between at least one of the determined material flow characteristics and a corresponding predetermined characteristic.

In a particular aspect, the method is specifically one of simulating operation of a steady flow separator, comprising: operating a simulated back pressure valve for an actual steady flow separator assembly; operating, at their respective locations in the steady flow separator assembly, actual valves of the steady flow separator assembly; determining, without actually flowing material through the steady flow separator assembly, an amount of material simulated to be in the steady flow separator assembly in response to the operation of the simulated back pressure valve and the actual valves; and displaying in real time at the steady flow separator assembly a visual indication of the simulated amount of material. This particular method also preferably further comprises recording data identifying a performance evaluation of an operator in response to the operator operating the simulated back pressure valve and the actual valves.

Therefore, from the foregoing, it is a general object of the present invention to provide a novel and improved cement mixing and pumps simulator and a method of simulating operation of a cement mixing system. Other and further objects, features and advantages of the present invention will be readily apparent to those skilled in the art when the following description of the preferred embodiment is read in conjunction with the accompanying drawings.

DETAILED DESCRIPTION OF PREFERRED EMBODIMENT

Figure 1:
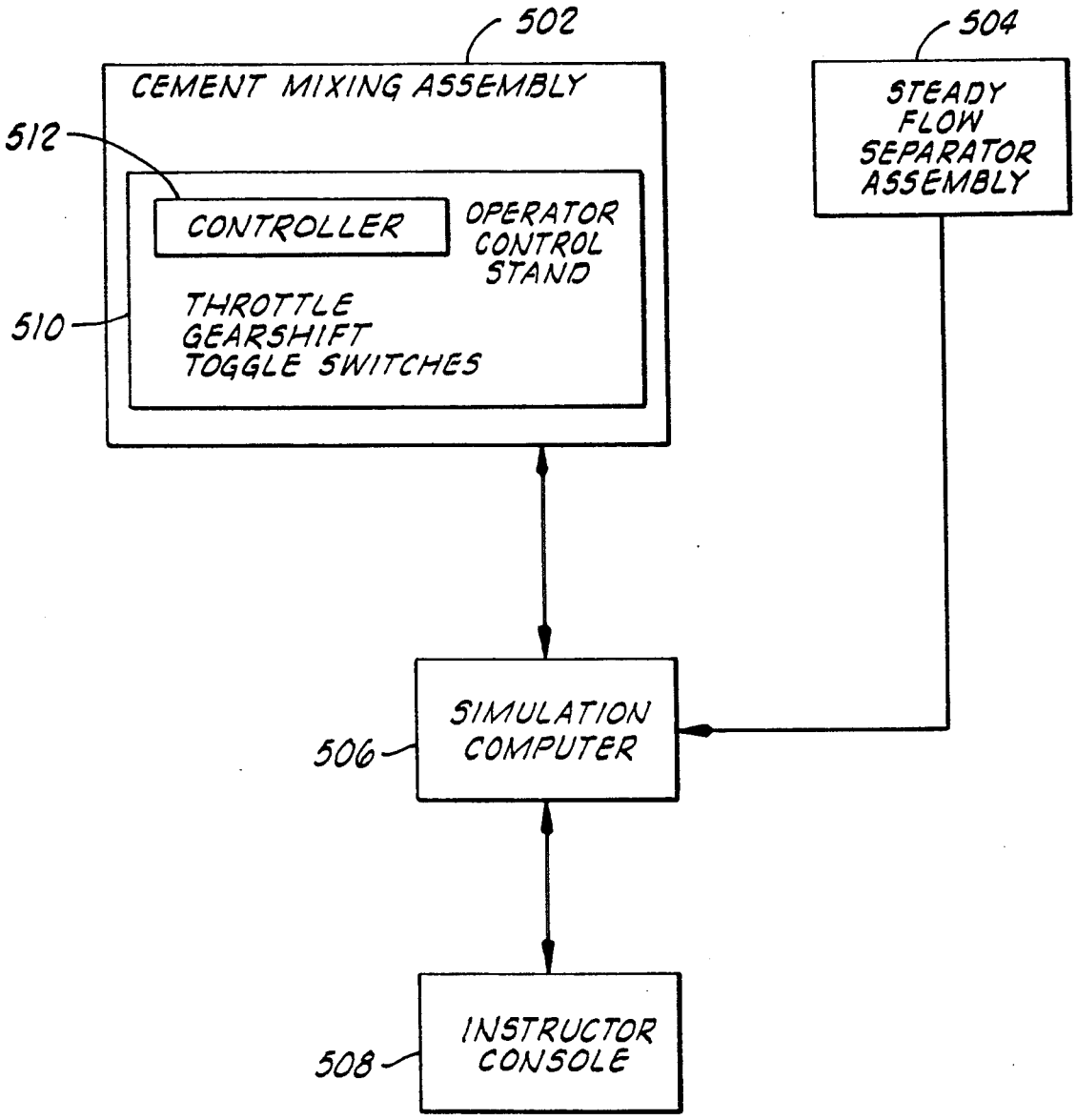
FIG. 1 is a block diagram of a simulator of the present invention.

The cement mixing and pumping simulator of the present invention comprises actual cement mixing equipment disposed in a realistic representation of a cement mixing system used in the field for mixing cement for an oil or gas well. The simulator also includes virtual cement mixing equipment means for representing actual operator-actuatable equipment of the cement mixing system. The virtual cement mixing equipment means is disposed with the actual cement mixing equipment so that this virtual equipment is physically operable by an operator training on the simulator. Referring to FIG. 1, the actual cement mixing equipment and the virtual cement mixing equipment means are embodied in both a cement mixing assembly 502 and a steady flow separator assembly 504.

The cement mixing and pumping simulator further comprises virtual pumping equipment means for representing actual pumping equipment of the cement mixing system.

The simulator also includes means for generating signals representing operating characteristics of the cement mixing system and for communicating the signals to the actual cement mixing equipment. This is done to display to the operator the operating characteristics represented by the signals so that the operator obtains real-time responses to his or her control of the actual cement mixing equipment and the virtual cement mixing equipment means. This means for generating and communicating is responsive to the operator controlling the actual cement mixing equipment and the virtual cement mixing equipment, and it is also responsive to the virtual pumping equipment means. In the FIG. 1 embodiment, the virtual pumping equipment means and the means for generating and communicating are embodied in a simulation computer 506 that also responds to an instructor's input through a console 508, such as a keyboard.

In the preferred embodiment, the simulation computer 506 also provides means for generating and recording data identified with the operator. The data is also related to a comparison between at least one of the operating characteristics displayed to the operator and a predetermined response for the same operating characteristic.

The cement mixing assembly 502 of a particular implementation is based on a Halliburton Energy Services HCS-25D cementing skid. This assembly 502 of the simulator includes a control stand 510 (FIG. 1) where the operator/trainee performs much of the hands-on control of the simulated system. The control stand 510 is configured to represent the actual control stand of the particular implementation. For the HCS-25D implementation, the control stand 510 has a controller 512 (FIG. which is implemented by a Halliburton UNI-PRO I or UNI-PRO II controller. The controller 512 operates in known manner during either manual or automatic control of the cement mixing assembly. The control stand 510 also includes a throttle, a gear selector, and valve actuators. In the particular implementation of the simulator, the throttle is electric rather than hydraulic as in the actual cement mixing system so that when the operator at the control stand 510 adjusts the throttle, an electric signal is provided to the simulation computer 506 to indicate the throttle setting. At least some of the valve actuators on the control stand 510 are implemented by toggle switches that provide electric signals to the simulation computer 506 to represent control of valves which would be implemented with pneumatic toggle valves and actuators in the actual cementing skid. Despite the substituted components, which are included in the aforementioned virtual cement mixing equipment means, the simulator control stand 510 still looks and is operated like the actual control stand of the particular implementation of the cement mixing assembly 502 The control stand 510 is preferably modular so that its panel can be changed out for different particular implementations.

Figure 2:
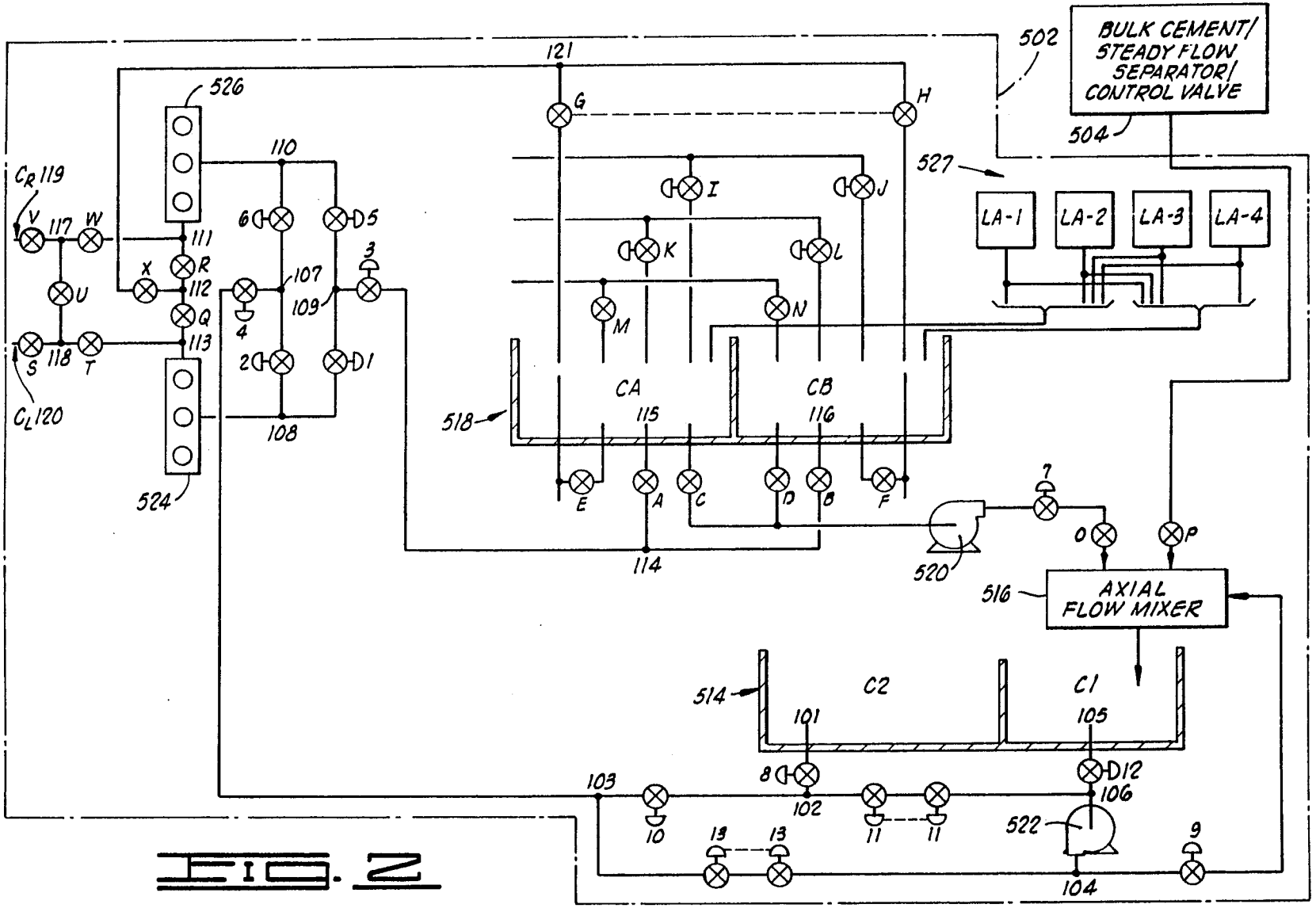
FIG. 2 is a schematic piping diagram for an embodiment simulating a particular cement mixing system used for mixing cement at an oil or gas well.

The remainder of the particularly simulated cement mixing assembly 502 will be described with reference to FIG. 2, which is a piping diagram of the particular implementation. Some of the illustrated components are actually implemented whereas others are virtually implemented. Included in the actual cement mixing equipment are the valves designated by letters A through X in FIG. 2; that is, these alphabetically designated valves are actual equipment physically present for the operator to see. These valves are mounted on a skid framework in the locations of their counterparts on an actual cementing skid used in the field. At least some of these actual valves are connected by manifolding (piping) sufficient to create the impression of the actual skid unit to the operator standing at the control stand 510. The actual valves preferably include counterparts for all the valves of the actual cementing skid that can be manually operated by the operator at the valves' respective locations rather than at the control stand 510. In FIG. 2, valves A through H and M through P can be physically operated by the operator if the operator leaves the control stand 510 and moves to the respective valve location. The same is true for valves Q through X. As to valves I through L, these valves are physically present, but virtually operated as will be explained hereinbelow.

The actual cement mixing equipment used in the simulator also includes one or more full size mixing tanks 514 (two tanks or two volumes separated by a weir within one tank are depicted in FIG. 2). The tanks 514 are physically present, but they are represented as capacitances C1 and C2 within the equations used in the simulation computer 506. An actual axial flow mixer 516 is mounted above the primary mixing volume.

Although mixing materials (e.g., water, dry cement) are not actually used in the present invention, their flows into the mixing tank 514 are simulated as are other flows in the cement mixing assembly 502. One flow into the mixing tank 514 that is simulated is the flow of dry cement from the steady flow separator assembly 504. This "flow" can be controlled at least in part by the operator physically operating valve P depicted in FIG. 2. Another flow into the mixing tank 514 that is simulated is the flow of liquid material from displacement tanks 518, which tanks are actually present in the simulator and are represented mathematically within the simulation computer 506 as capacitances CA and CB. This "flow" can be controlled at least in part by the operator physically operating valves C, D and 0 shown in FIG. 2. This liquid "flow" is obtained by the simulated operation of a virtual pump 520 defined in the simulation computer 506. The valve can be manually controlled by the operator or automatically controlled by the controller 512 to obtain the targeted virtual density of cement mix.

Outlet flow from the tanks 514 is also simulated. A virtual pump 522 implemented in the simulation computer 506 can be used to simulate recirculation flow back to the axial flow mixer 516 and to simulate flow to virtual downhole pumps 524, 526 through the various depicted valves.

From the simulated inlet and outlet flows, the simulation computer 506 computes the volumes of mixture that should be in the tanks 514. The simulation computer 506 outputs electric signals to control visual indicator means, such as light emitting diode bar graphs disposed in the mixing tanks, for representing to the operator the level of the mixture in the tank. The same type of indication is given in the displacement tanks 518. This display in a tank in response to the simulation computer 506 computing a simulated amount of the respective material or mixture allows the operator to actually look into the actual tanks of the cement mixing assembly 502 and observe a simulated fluid level in the tanks themselves.

The fluid levels in the displacement tanks 518 are responsive to the aforementioned simulated flow through the virtual pump 520 (or to a simulated outlet flow through manually controllable valves A and B, or to a simulated outlet flow through manually controllable drain valves E, F) and a respective simulated inlet flow. The inlet "flow" into one of the tanks 518 comes (1) through manually operable valves M and N and virtual operation of valves I, K and J, L that the simulation computer 506 responds to as controlling mix water and mud inlet flow and (2) through manually operable valves G, H that the simulation computer 506 responds to as controlling the virtual flow from the downhole pumps 524, 526 and/or the well and (3) through virtual flow from actually implemented liquid additive tanks 527. Virtual flow from the liquid additive tanks 527 is established in a particular implementation by two switches and a potentiometer as explained further hereinbelow.

As should be apparent from the foregoing, all actual cement mixing equipment that is used in the present invention and that is significant to simulating operation of the cement mixing system or to evaluating how the operator performs has respective sensors which sense how the respective equipment has been set or controlled by the operator and which generate electric signals and communicate them to the simulation computer 506. Suitable sensor devices are known in the art (e.g., devices including switches or potentiometers).

The foregoing has been directed primarily to the actual cement mixing equipment used in the present invention; however, FIG. 2 also depicts some of the virtual cement mixing equipment means. This virtual cement mixing equipment means includes the aforementioned plurality of toggle switches mounted on the operator control stand 510. For the FIG. 2 implementation, these toggle switches represent the valves and valve actuators identified in FIG. 2 by the reference numbers 1–13. On an actual field cementing skid, pneumatic toggle valves at the control stand drive pneumatic actuators at the respective valves; as previously mentioned, in the simulator of the present invention, toggle switches replace the pneumatic toggle valves on the control stand 510 so that when the operator actuates a toggle switch, an electric signal representing the action taken is provided to the simulation computer 506.

As to the virtual operation of the actual valves I through L, there are in addition to these actual valves corresponding toggle switches, simulating toggle air valves, located on the side of the displacement tanks 518. It is these toggle switches that the operator manipulates to effect virtual operation of the actual valves I, J, K and L. When the operator moves one of these toggle switches, an electrical signal is sent to the simulation computer 506 to represent the state of the respective valve I, J, K or L.

The previously mentioned virtual pumping equipment means of the present invention includes the pumps 520, 522, 524, 526. This equipment means also includes simulation computer defined transmissions and engines that are used to drive the pumps. These virtual devices are described by empirically derived equations and equations describing the dynamics using methods familiar to those skilled in the art.

Figure 3:
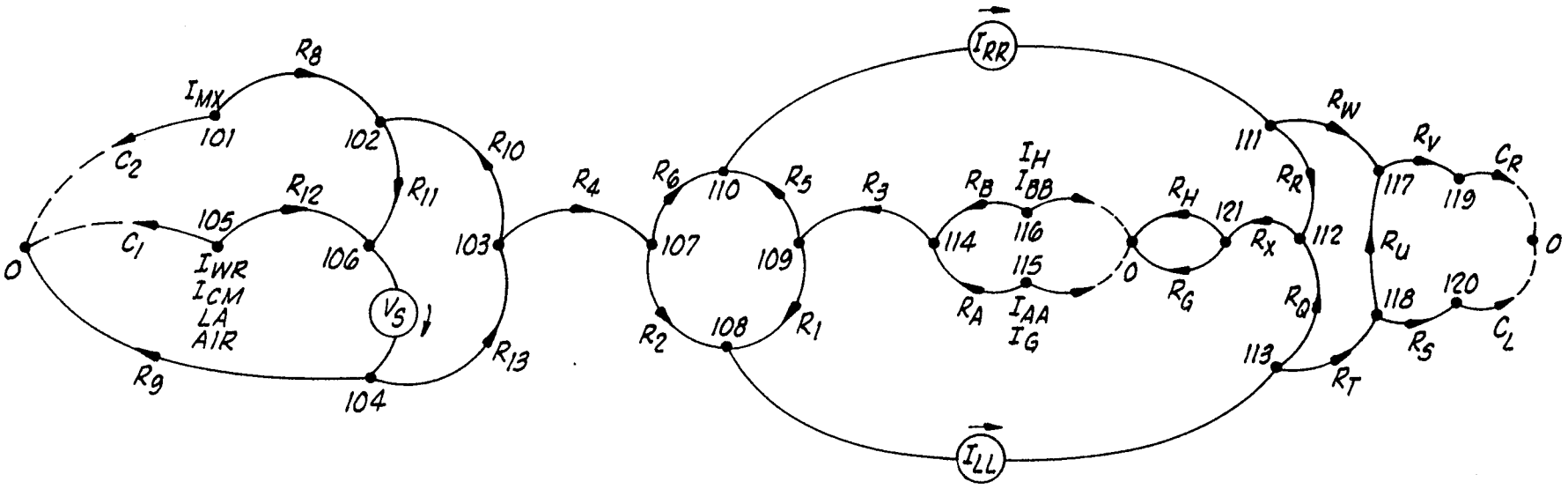
FIG. 3 is a signal flow diagram for the embodiment of FIG. 2.

A flow diagram for the simulation of the above-described skid implementation is shown in FIG. 3. The numerical intersections of the flow diagram correspond to the like-numbered junctions shown in FIG. 2. Resistances R correspond to the like numbered or lettered valves, and the capacitances C correspond to those shown in FIG. 2. Other parameters are defined as follows:

$I_{MX}$=overflow from C1 to C2

$I_{WR}$=inlet mix water rate $I_{CM}$=inlet cement rate

LA=inlet liquid additive rate

AIR=entrained air in outlet flow $V_S$=pressure of pump 522

Figure 4:
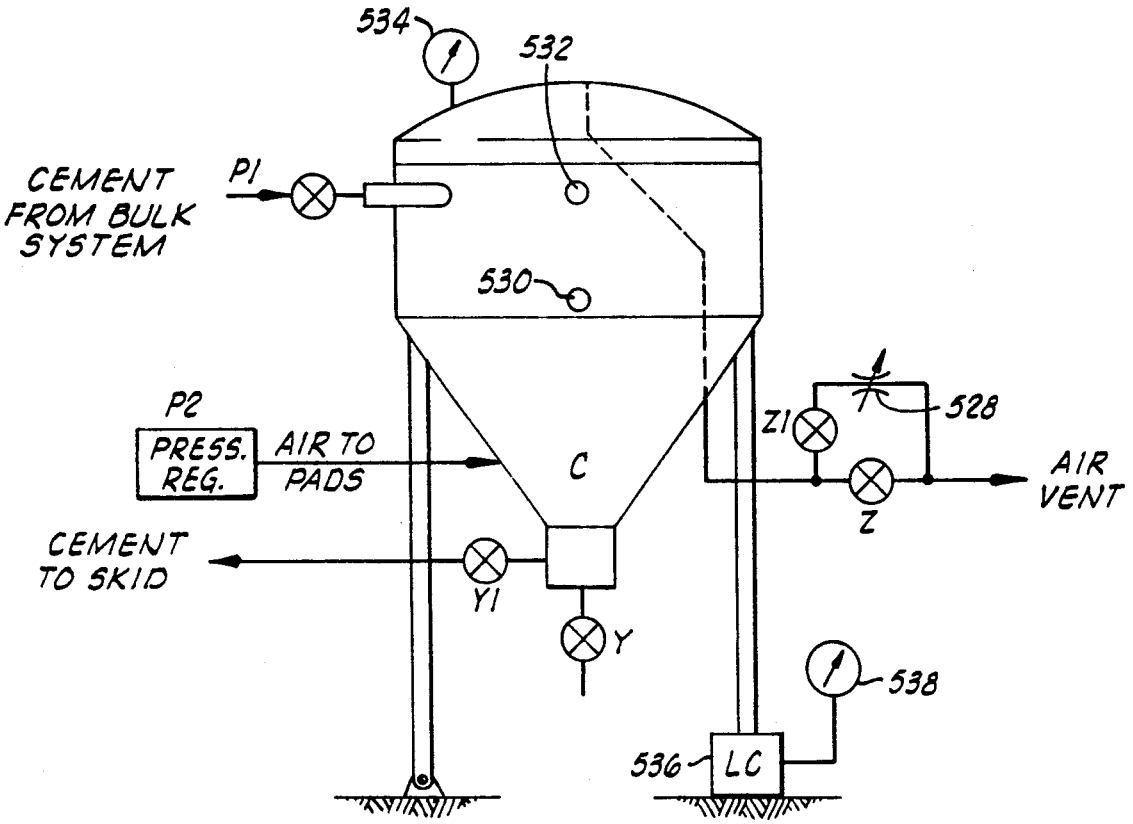
FIG. 4 is a schematic representation of a steady flow separator assembly of the embodiment of FIG. 2.

$I_{RR}$=downhole pump 526 rate $I_{LL}$=downhole pump 524 rate $I_H$=outlet flow from pumps 524 and/or 526 and/or flow from well $I_{BB}$=inlet flow of all additives $I_{AA}$=inlet flow of all additives $I_G$=outlet flow from pumps 524 and/or 526 and/or flow from well The steady flow separator assembly 504 simulated with the above-described skid as part of the overall simulated cement mixing system is a Halliburton Energy Services 80-cubic foot steady flow separator generally identified in FIG. 2 and more particularly shown in FIG. 4. The actual cement mixing equipment present for the operator to see and control are those shown in FIG. 4 except for a back pressure valve or orifice 528. The device 528 and its associated actuating components are replaced in the present invention by a variably controllable potentiometer at the control stand 510, thus the potentiometer implements a virtual back pressure valve or orifice. In response to operator control, the potentiometer causes an electric signal to be sent to the simulation computer 506. From this signal the computer 506 can calculate a back pressure for the steady flow separator assembly 504. This back pressure control is used in a manner known in the art.

The container C (C representing a capacitance for the simulator's calculations) of an actual field steady flow separator assembly has a plurality of sight glasses that enable an operator to see whether the level of the material in the container is above or below the respective sight glass. Since no material is used in the present invention, this function is represented by two virtual sight glasses, namely, lights 530, 532 mounted on the side of the container C as shown in FIG. 4. If the simulated level of material in the container C is at or above a level where an actual sight glass would be, the respective light representing such sight glass is illuminated.

The simulation computer 506 also computes a simulated pressure for the interior of the container C. This "pressure" is displayed via a pressure gauge 534 mounted in the assembly 504 correspondingly to its known respective location within an actual steady flow separator.

The simulation computer 506 computes a simulated weight of the simulated amount of material within the container C. This weight would be sensed by a load cell 536 in a field steady flow separator system. The simulated weight in the present invention is displayed to the operator via a pressure gauge 538 calibrated to indicate weight.

Valves Y, Y1, Z shown in FIG. 4 can be manually controlled by the operator. Respective sensors generate and communicate to the simulation computer 506 electric signals indicating the states of the valves. Actual cement control valve P attached to the axial flow mixer 516 is manually controlled by the operator or automatically controlled by the controller 512 to obtain the targeted virtual density of cement mix.

Figure 5:
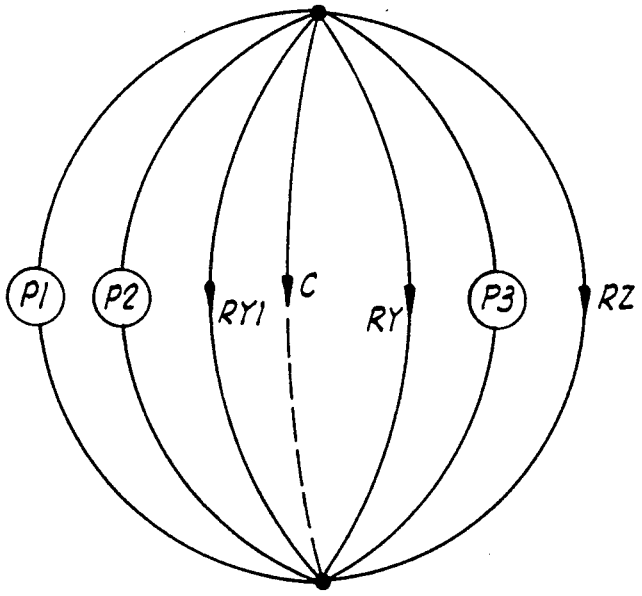
FIG. 5 is a signal flow diagram for the assembly of FIG. 4.

A flow diagram for the described particular implementation of the steady flow separator assembly 504 is shown in FIG. 5. P1 in FIG. 5 is the bulk pressure, P2 is the pressure on the regulator supplying air to the aeration pads and P3 is the back pressure regulator setting. C is the capacitance of the steady flow separator. RY, RY1 and RZ are the resistances due to the valves Y, Y1, Z, respectively, in FIG. 4. This diagram is used along with the continuity equations and conservation of mass equations to develop the equations which describe the dynamic operation of the steady flow separator and which are apparent to one skilled in the art.

Either or both of the above-described cement mixing assembly 502 and steady flow separator assembly 504 can be used in the method of the present invention. This method will be generally described next, followed by a more detailed description of its implementation using the simulation computer 506.

In simulating the operation of the cement mixing system described above, the operator/trainee operates at least one control device of the cement mixing system. Such one or more control devices as referred to here preferably are located at the master control location defined in the preferred embodiment by the control stand 510, which is located within the assembly 502 to give a realistic training environment. In response to such operation, respective signals are generated to indicate the control effected by the operator. The generated signals are communicated to the simulation computer 506. By way of example for the cement mixing assembly 502, such control includes operating the throttle and transmission gearshift for the downhole pumps 524, 526 and the virtual valves implemented by toggle switches on the control stand 510. As for the steady flow separator assembly 504, such operating relates to the simulated back pressure valve implemented by a potentiometer at the control stand 510.

In simulating operation of the cement mixing system with the present invention, the operator also typically operates at least one of the actual equipment of the cement mixing system located away from the master control location defined in the particular implementation by the control stand 510. This control occurs by the operator moving to the respective location of the particular equipment within the assembly of actual cement mixing equipment. Respective signals indicating the control effected by the operator are generated and communicated to the simulation computer 506. In the particular implementation, this control pertains to the actual valves A through H and M through X in FIG. 2 and the actual valves Y, Y1, Z and Z1 in FIG. 4. Virtual operation of actual valves I through L occurs by the operator moving to and operating the toggle switches on the displacement tanks 518 referred to above.

As the operator controls the actual and virtual equipment of the cement mixing assembly 502 and/or the steady flow separator assembly 504, the simulation computer 506 determines characteristics of material flow through the actually and virtually implemented system. This control is responsive to the operator's control of the various devices and occurs without actually flowing material through the cement mixing system. The simulation computer 506 generates output signals representing at least one flow characteristic of material thereby simulated to be flowing through the respective assembly due to the respective control by the operator.

Such simulated responses are computed and displayed in real time relative to the control being effected by the operator and the material flow responses being computed by the simulation computer 510. This immediately apprises the operator of the material flow obtained in response to the operator's control. In the particular implementation, the information is displayed to the operator via displays of the UNI-PRO controller 512 of the cement mixing assembly 502 and the gauges 534, 538 of the steady flow separator assembly 504.

The foregoing steps are repetitively performed so that the operator continually controls the control devices and the actual cement mixing equipment in response to the displayed characteristic(s).

The method of the present invention also includes generating and recording data identifying a performance evaluation of the operator in response to a comparison between at least one of the determined material flow characteristics and a corresponding predetermined characteristic, namely, a predetermined standard for the respective characteristic. For example, a simulation exercise may be set up to obtain a cement slurry that has a desired density or weight that is to change over the course of the exercise This defines the predetermined standard against which the operator is to be evaluated. Evaluation of the operator can then be based on, for example, (1) how close to this desired characteristic the operator can "produce" the simulated cement slurry that is computed in response to the operator's control of the components at the control stand and throughout the assemblies 502, 504, and (2) an integrated value indicating how steady or unsteady were any deviations from the standard.

In a specific implementation, the evaluation of the simulator run can be made using the Halliburton program CJOBA. This will evaluate the quality of the job based on the original job design from CJOBSIM. Further evaluation of the data is left to the instructor using PC programs such as LOTUS 123 or other spread sheet program.

The data from the simulator is recorded in several files. The first file contains job data, which includes rates, pressures, and densities during the job. The second file is for the system performance data which includes such parameters as engine speed, engine temperature, and other engine parameters, as well as fluid levels, centrifugal pump speeds, agitator setting, rig air pressures, bulk weight, and other general system parameters. The third file is an event log which records the instructor's or student's actions on the simulator, wherein each event is identified as to who generated the event and what time the event happened. Examples of events which are recorded are engine start, engine stop, which valve has been opened or closed, what fluid is in what pipe segment, status of the lube system if it failed during the job, and if a tub overflowed during the job.

The simulation computer 506 is used in performing the foregoing method. The computer 506 preferably has a multi-tasking operating system so that more than one program can run at a time to allow real-time response to the operator's control of the components at the control stand 510 and throughout the actual equipment assemblies. The computer 506 also needs sufficient input/output capability to handle the necessary communication signals between the assemblies 502, 504 and the computer 506. A list of inputs and outputs for the particular implementation is set forth in the Appendix forming a part of this specification.

The simulation computer of a specific implementation is a computer system based on the VME bus standard and includes a CPU board with a 25 MHz 68040 CPU, 32 MBytes of memory, a TCP/IP networking port, 2 serial ports, and a parallel port for a printer. Three analog out boards are used along with two analog input boards, two digital input boards, and a board able to produce frequency outputs. The CPU board is manufactured by MIZAR, while the I/O boards are produced by XYCOM. The simulation computer also provides hard disk storage, a streaming tape backup system, and a 3.5 inch floppy disk.

The software is a multi-tasking system using several processes communicating with each other to accomplish the task. The operating system is a real-time operating system. The instructor interfaces with the simulation computer using an interface that takes advantage of the X-Window system, thus providing the instructor the ability to have more than one display on the screen at one time.

The simulation computer 506 is used to monitor and respond to the electric signals generated at the control stand 510 and at the actual equipment within the assemblies 502, 504 in response to the operator's control. The computer 506 also generates and stores data about the operator's performance, and it generates reports on simulation runs for display through a monitor and printer of the overall computer system. In the particular implementation, the simulation computer 506 performs post-simulation analysis using CJOBSIM and CJOBA from Halliburton Energy Services.

To perform its functions, the computer 506 includes suitable programming. This programming is preferably modular in that programs are developed as separate processes to model various components or functions of the assemblies 502, 504. These are preferably designed as universally or generically as possible so that existing modules can be used or readily adapted or replaced if changes are made to the simulator. If possible, it is preferred to have one set of mathematical equations that can be adapted to every desired condition so that this can be reused in different modules. Flexibility as to operating conditions (e.g., the ability to define equipment as either properly working or malfunctioning, to simulate downhole conditions, and otherwise not be limited to any certain predetermined set of training exercises) is preferred. Creating a realistic experience to the operator is also an important criterion of the preferred embodiment. For achieving this, the models can be empirically or mathematically derived as preferred or practical. Realism can be enhanced such as by incorporating: a video of the pumps pumping at the speeds computed by the simulation computer 506; sound of pump-driving engines changing as the throttle is changed; and vibration of the simulator structure.

The following are examples of processes that are implemented in the particular implementation and that are separate processes running in real time to simulate various aspects of the cement mixing system; these processes communicate with each other to provide the information needed to produce a realistic simulation:

graphical control display of a simulation run
simulation of a cement job:
simulation of operator's console
simulation of cement mixing and recirculation
simulation of displacement tanks
simulation of liquid additive proportioning
simulation of manifolding
simulation of bulk material flow
simulation of pumping slurry downhole
data logging of a simulation run
transfer of simulation log.

The instructor's interface is a graphical interface with the main window showing an overview and current status of the complete skid. This shows tank levels, valve positions, drive train status, density, rate, pressure and volume information in real-time Secondary displays focus on more detailed information of each component of the system One secondary display is a strip chart of the density values as the job is being run. It is from this console on a secondary display that the instructor is able to introduce faults into the system.

The operator's console simulates the engines, transmissions, and pumps. The operator can advance or retard the throttles, shift the transmission, and monitor the engine gauges. The information displayed on the gauges includes realistic values based on the engine, transmission, and pumps used. The rate, pressure, etc. are based on the values produced by this process.

Simulation of the cement mixing takes the operator's input or input from a Halliburton Energy Services ADC unit and responds in a realistic manner. Depending on the state of the valves, pumps, downhole conditions and possibly other variables, a realistic pressure is generated. Tub levels are generated and the densimeter responds as if a real job was being run with these conditions.

Displacement tank simulation handles the inputs and outputs necessary to give realistic filling, overflow, or empty conditions. These depend on valve positions, rate and other variables. Tank level indicators are provided inside the tanks so that the operator needs to walk to a tank and look inside to see the level.

Liquid additive proportioning is simulated. The simulation takes into account the viscosity of the additive, the valve position, dump rate, etc. The valves will be in the correct physical location on the skid requiring the operator to walk to the system to throw the valves. The instructor can enter viscosities and feed rates.

The H-manifold simulates what happens when the high pressure valves are opened or closed. The position of the valves will be used to determine the flow path from pumps 524, 526 to the well. The H-manifold allows either pump to be isolated from the well and the other pump or it allows the connection of both pumps to the well.

The bulk system is simulated and gauges are provided for the operator to read as described above. These gauges show the surge tank (container C in FIG. 4) weight and the surge tank pressure These respond realistically based on the current job parameters.

The simulation computer 506 logs the actions of the student, such as the valve positions, density reading, job rate, pressure, tank levels, time, etc. The computer 506 generates from this data reports needed to document the operator's performance.

The following are additional programs for the particular implementation:

communications with the simulation computer
CJOBSIM capability
retrieve a simulation run
report generation of a simulation run
create data base of an operator's runs.

Communication with the simulation computer 506 is through an off-the-shelf emulation package such as PROCOMM.

CJOBSIM capability is provided through the Halliburton CJOBSIM program and allows the operator to learn how to design the job using the program as he or she would for a real job. The results of the simulation run can be compared to the CJOBSIM run to show how well the operator executed the designed job.

Retrieval of the simulation run is accomplished by using the terminal emulation program mentioned above. The file transfer option of the emulation program is used to retrieve the operator run log from the simulation computer.

The report generation of the simulation run generates the necessary reports of the simulation run. This report will show the time and what action the operator took or performed. Density, rate, pressure, and volumes are recorded as well as valve positions, engine status, tank levels and other pertinent information. A separate option is provided to compare the simulation run of density, rate, pressure, and volumes to what was designed with CJOBSIM. CJOBA is used to run the comparison.

Figure 6A:
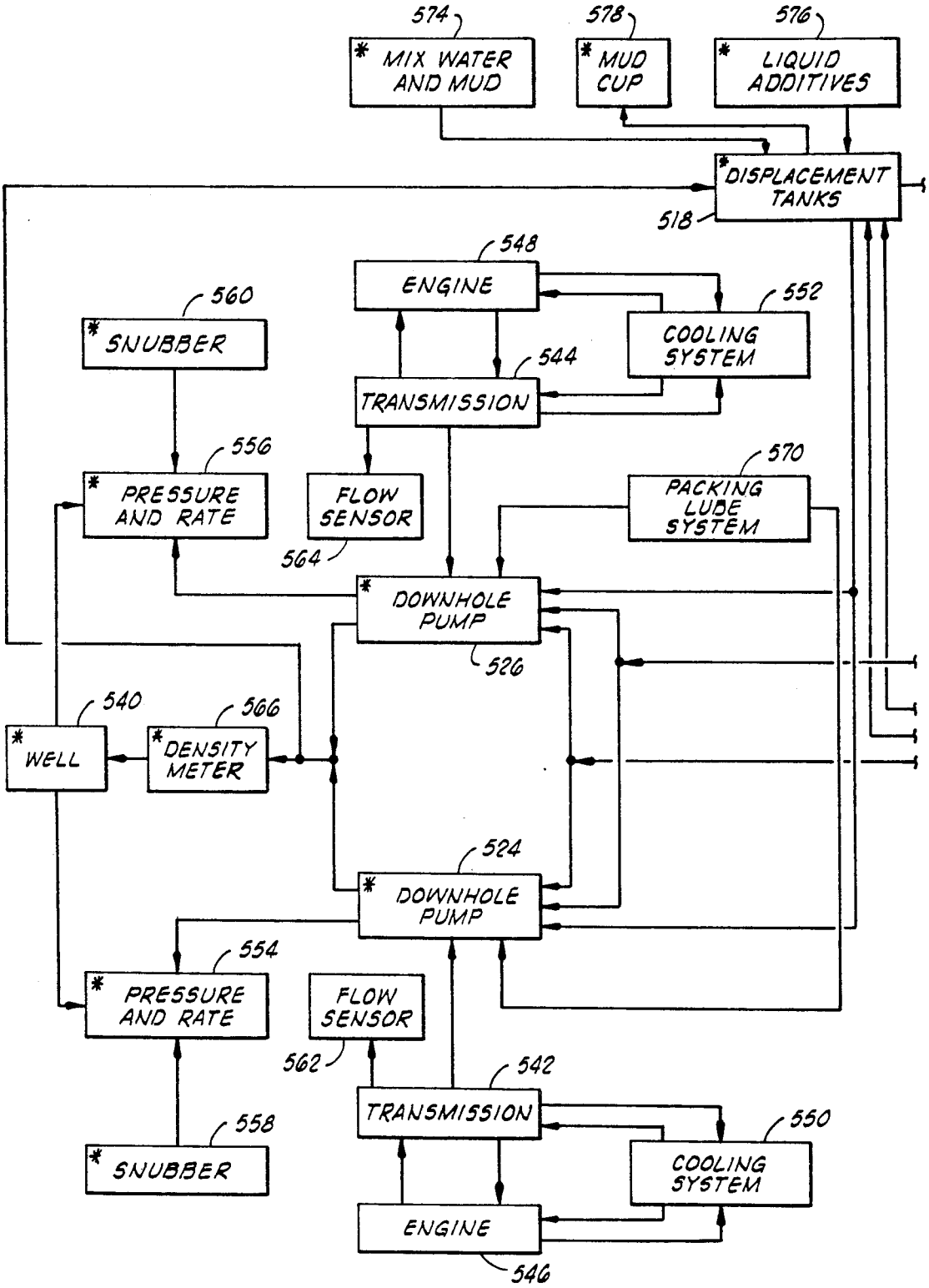
FIGS. 6A and 6B are an overall block diagram of the simulator including the embodiments of FIGS. 2 and 4.
Figure 6B:
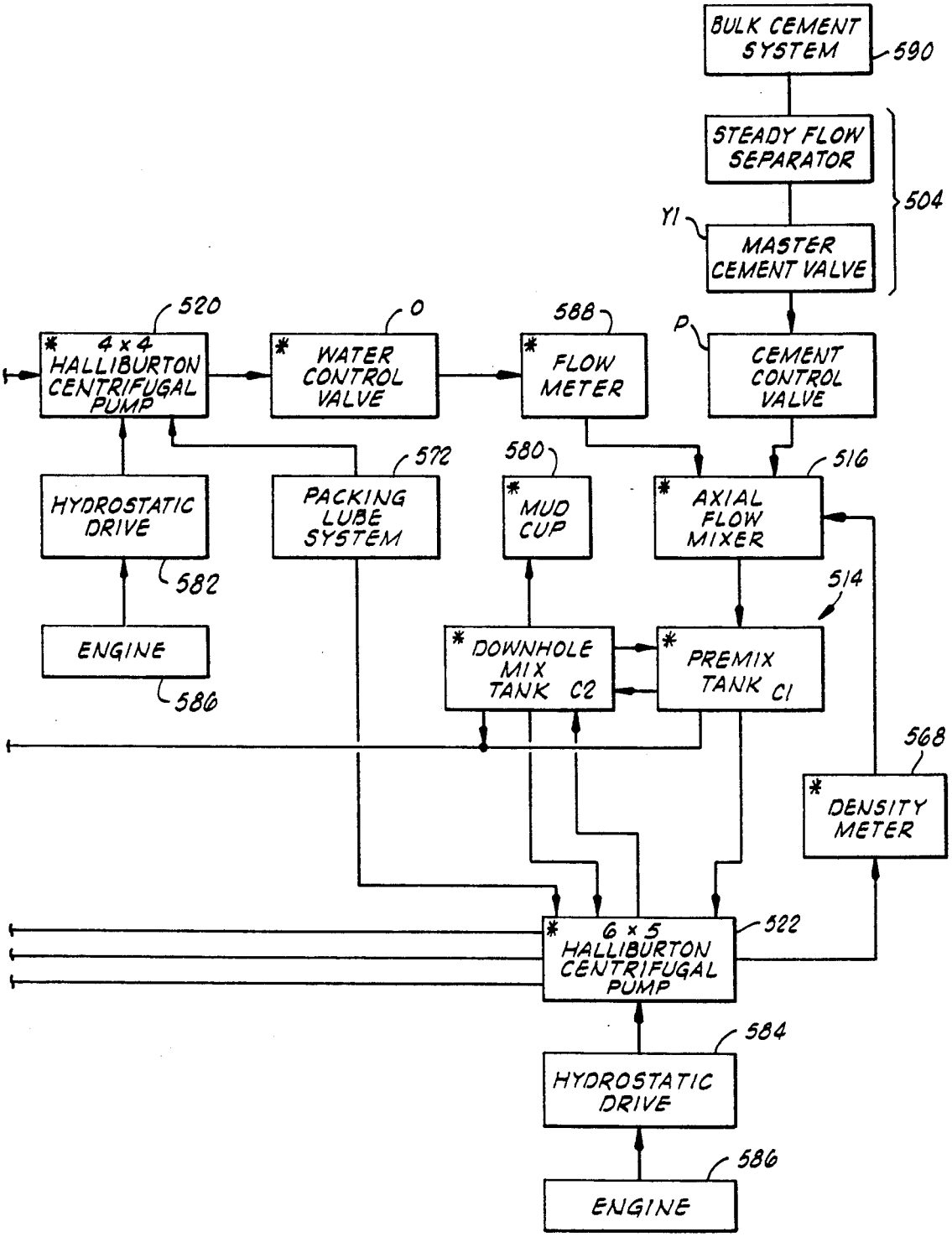

The following gives a more detailed explanation of the software for the particular implementations shown in FIGS. 2–5 as combined in FIGS. 6A and 6B. The following is referenced primarily to FIGS. 6A and 6B.

WELL 540

The well model includes a real-time version of CJOBSIM from the Halliburton ACQUIRE software.

DOWNHOLE PUMPS 524, 526, TRANSMISSIONS 542, 544 & ENGINES 546, 548

The models for these three blocks are intimately related. The inputs to the downhole pump model are the transmission output speed, the pressure from the pressure and rate model, and the restrictions due to the piping model. The outputs are the average pressure and flow rate to the pressure and rate model and the torque to the transmission model. Inputs to the transmission model are engine speed, engine torque capability, and gear selected. The outputs of the transmission model are tail shaft speed to the flow sensor and downhole pump, heat load to the cooling system model, transmission main oil pressure, and torque required from the engine. Throttle position and temperature from the cooling system model are the inputs to the engine model. The outputs from this model are engine speed and torque to the transmission model, engine oil pressure, and heat load to the cooling system model.

These three models interrelate in the following ways. The transmission gear selector has five positions and neutral. If first gear is selected, the transmission will stay in first. If second gear is selected, the transmission will start in second and stay in second. If third gear is selected, the transmission will start in second and shift up to third if conditions will allow the shift and then can downshift back to second when load increases. Selection of fourth gear allows the transmission to start in second gear and shift to third and then to fourth if conditions allow the shifts. Likewise, the transmission can automatically downshift from fourth to third to second as load increases. Selection of fifth gear starts the transmission in second gear and allows automatic upshifts from second through fifth and downshifts from fifth through second as load increases.

When the transmission is placed in gear, the torque converter is out of lock-up. The torque due to pump pressure is used to calculate the required output torque from the transmission. If the torque available from the converter at the specific engine speed is greater than the required torque, then the speed ratio between the input and output of the torque converter will increase until the ratio reaches 0.90. At this point, the torque converter will go into lock-up. The speed ratio when not in lock-up is calculated using a Newton Raphson iteration from empirical equations giving available torque from the converter as a function of engine speed.

First order response is used to describe the response of the engine to a throttle change.

If the required torque is great enough, the speed ratio will never reach 0.90. A continued increase in pump pressure (required torque) will cause the speed ratio to lower. When the torque required is greater than the available torque, the engine will lug back to a speed having a larger torque and a new speed ratio will be calculated.

A typical upshift sequence is as follows when placed in fifth gear. Fifth gear is used since any other gear from third to fifth will have the same manner of operation with the higher gear selection having a higher attainable gear. The transmission will start in second gear out of lock-up. The torque converter's ratio will continue to increase until a ratio of 0.90 is reached. At this point, the converter will go into lock-up. If the speed for an upshift is reached before a speed ratio of 0.90, then the transmission will upshift to the next gear and the speed ratio will drop due to the increased torque on the converter. The input to output speed of the converter is given as a first order response with a time constant matching the general response for accelerating the mass in a viscous fluid. The same procedure is followed until the highest gear selected is reached. At this point, the speed ratio continues increasing until the converter goes into lock-up.

The following describes a downshift with each being the same. While in lock-up with rising pump pressure, the pressure will continue rising with constant pump rate until the required torque is greater than the available torque. At this point the engine speed will lug back to a higher torque rating and corresponding lower pump rate. The engine will continue lugging back until the available torque matches the torque where the converter falls out of lock-up. When falling out of lock-up, the engine speed will rise due to the torque converter's lowered ratio. As the pump pressure continues to rise, the torque converter ratio will continue to fall until the torque available is less than the torque required. The engine will again start lugging back until the available torque equals the required torque. This lug back will continue until the transmission output speed falls to the speed set for a downshift. At this point, the gear ratio will change to the next lower gear and the speed ratio will increase until the converter is again in lockup. As pump pressure continues to rise, the pump rate will remain constant until the engine again begins to lug back. The same procedure will continue until second gear is reached when the gear selector is in third, fourth, or fifth.

When second gear and the converter out of lock-up is reached, the engine will continue lugging back until the engine's peak torque is reached. Any increase in pump pressure will cause the torque required to be larger than the maximum torque available from the engine and the engine speed will be set to zero since the engine will die under such conditions.

When in first or second gears, the converter operation and engine lug back will be the same as described above, only the transmission model will be locked into the selected gear to prevent up shifting or downshifting.

The engine, transmission, and pump that are specifically simulated as just described in the particular implementation are the following:

| | |
|---|---|
| engines 546, 548 | Caterpillar 3406B |
| transmissions 542, 544 | Allison HT-750 |
| pumps 524, 526 | Halliburton HT-400 |

COOLING SYSTEM 550, 552

The cooling system model takes into account heating from both the engine and transmission. The engine has a heat exchanger for cooling the transmission. This cooler has a limited cooling capacity which can cause the transmission to overheat if more cooling is required. When the torque converter is run out of lock-up, more heat is produced with a lower speed ratio due to greater slippage within the converter. Empirical equations were developed relating transmission heat load to torque converter ratio and torque. The engine is cooled by an external heat exchanger with a limited cooling capacity. An empirical model was also developed relating engine heat rejection to the cooling water jacket as a function of brake horsepower and engine speed. The engine's cooling system includes a model of the thermostat which allows different temperature rated thermostats to be selected. The combined heat load from the engine and transmission are input to the cooling system model along with ambient temperature. If the engine or transmission temperatures exceed preset limits, then the engine or transmission will fail and stop working.

PRESSURES AND RATES 554, 556, AND SNUBBERS 558, 560

The pressure and rate model has inputs from the pump, snubber (a variable orifice controlled to set meter damping) and well models. The pump model is for a triplex pump. If one of the suction valves is held open, then the flow rate is decreased by one-third and there are larger fluctuations in pressure. Equations were developed to model this situation. One, two or all three suction valves can be modeled as stuck open to give the corresponding flow and pressure conditions. The pressure from the model is displayed on an analog meter built to look like a high pressure gauge. A model of a snubber upstream of the pressure gauge allows the simulation of mechanical filtering of a pressure signal to remove the pressure pulsations due to the triplex pump.

FLOW SENSORS 562, 564

The flow sensor model calculates the flow rate from the transmission tail shaft speed and the pump displacement.

DENSITY METERS 566, 568

The density model takes the density value from the piping model and outputs a frequency equivalent to the frequency from a radioactive densimeter. This frequency goes to the UNI-PRO controller 512 on the simulator skid as density feedback in a density control loop within the controller 512 for the low pressure recirculation density meter 568. The virtual density for the high pressure downhole density meter 566 is only displayed by the controller 512.

PACKING LUBE SYSTEMS 570, 572

There are two packing lube systems: one for the triplex pumps and one for the centrifugal pumps. Both systems model air pressurized systems which provide oil to the packing on the pumps. A dipstick in each reservoir trips a switch indicating that the oil level has been checked. The model assumes that when the oil is checked it is refilled. Therefore, anytime the oil is checked, the model will automatically refill its respective reservoir. Switches are also on the valve providing air to the reservoir and bleeding air from the reservoir before checking. If the valve is not opened to model pressure on the reservoir, then no oil will flow and pump packing failure will be indicated.

DISPLACEMENT TANKS 518

All valves on the tanks have sensors to indicate the position of the valves. Continuity equations and conservation of mass equations are used to determine flow and density of fluids into and out of the displacement tanks. Three-foot long bar graphs in each tank indicate the level of the fluids since there is no fluid in the tanks.

MIX WATER AND MUD 574

The mix water and mud models have sensors on all valves to indicate the position of the valves. These fluids are normally provided by the customer's pumping equipment; therefore, models of their flow through valves use a pressure source which can be changed to simulate the pressure available on a particular rig.

LIQUID ADDITIVES 576

The flows of liquid additives are normally controlled by air actuated valves to fill and empty the additive tanks 527. To virtually implement this, there are two switches and one potentiometer on the simulator for the liquid additives. Normally a liquid additive tank has a float which trips an air valve when the tank reaches a preset level while filling. The float trips a different valve when empty. The real system has an adjustable collar on a rod to set the trip level when filling. To simulate this, the potentiometer raises an indicator on a three-foot bar graph on the face of the liquid additive tanks 527 which simulates a sight glass used in an actual field system. The indicator is set at the same level the collar would manually be set. Operation of one momentary switch represents fluid dumping either to the right displacement tank or the left displacement tank. The other switch has three positions: auto, manual and manual fill. The auto position represents automatic filling of the liquid additive tanks when emptied. The manual position represents the liquid additive tank emptying and not refilling. The momentary position of manual fill represents the liquid additive tanks beginning to fill when the switch is tripped. The three-foot bar graph indicates the level of fluid at all times. Since one cannot see the fluid emptying due to there being no fluid in the simulator, the top of the bar graph has an indicator showing whether the represented dumping is to the right or left displacement tank.

MUD CUPS 578, 580

If the density meter fails, an operator has to measure density with a manually operated pressure mud cup balance. To simulate this, a switch is placed on both the mix tank and the displacement tanks. When pressed, a request is made for the density. The instructor has previously entered a time delay before a digital display will indicate the density of the fluid which was in the tank at the time of the request. This time delay simulates the time required to make a manual measurement of density with a mud cup balance. This time delay is set by the instructor so it will be indicative of the time required by a particular operator to make the measurement.

4×4 AND 6×5 HALLIBURTON CENTRIFUGAL PUMPS 520, 522

Empirical models of the centrifugal pumps were developed which give the pump pressure as a function of engine speed, flow rate, and specific gravity.

HYDROSTATIC DRIVES 582, 584 AND ENGINE 586

The same engine is used for both the 4×4 and 6×5 centrifugal pumps. It is assumed that the engine is already running at full speed for the particular implementation. A first order lag is used to approximate the characteristics of the hydrostatic drives used for the centrifugal pumps.

WATER CONTROL VALVE O

An empirical model was developed for the water valve from test data which gives the flow rate through the valve as a function of the pressure from the 4×4 centrifugal pump and valve position.

FLOW METER 588

The flow meter model uses the flowrate from the 4×4 centrifugal model as input and a frequency corresponding to the equivalent flow rate from a 3 inch Halliburton turbine flow meter as the output.

BULK CEMENT SYSTEM 590

The bulk cement system is modeled as a pressure source. The air flow rate from the system is a function of the square root of the difference in pressure between the steady flow separator and the bulk system. The cement flow rate is a function of the saturation factor for a 5 inch flow line and the air flow rate.

STEADY FLOW SEPARATOR 504 WITH MASTER CEMENT VALVE Y1

Cement and air enter the separator from the bulk system. The back pressure valve maintains a constant back pressure on the separator. The back pressure valve is adjusted with the previously mentioned potentiometer representing an air pressure regulator in the control stand 510 of the cementing simulator skid. The back pressure valve is modeled as a constant pressure unless the cement is allowed to fill to the top and blows into the vent line and plugs the back pressure line. At this point, valve Z (FIG. 4) must to be opened to bypass the back pressure valve and try to clear the cement from the back pressure valve. If it will not clear, then valve Z1 is closed and Z is used to manually throttle the air being vented. If during the simulation the models indicate that the back pressure valve should be plugged, then no flow will be allowed through it until the operator opens and closes valve Z a predetermined number of times set by the instructor.

The other input to the steady flow separator is air injected through the air pads to keep the cement fluid. This air is supplied through a regulator which is set 2 to 4 psi greater than the separator operating pressure.

Cement exits the separator from valve Y1 or Y. Valve Y1 opens to a line attached to the cement control valve P on the skid. Valve Y is used if a ground mixer is used to mix cement. At this time, valve Y is not used in the particular implementation of the simulation other than allowing leakage of air and cement if it is not closed. The rate of flow of cement from the separator is modeled by the characteristics of the cement control valve.

Continuity and conservation of mass equations are used to calculate the air flow and cement flow to and from the separator. There are normally three levels in the separator monitored by sight glasses. One is on the sloped portion of the tank and two on the straight sided region. The lower sight glass is not simulated but the upper two are simulated with the two lights 530, 532. A large analog electric meter is used to simulate the load cell pressure gauge 538. The pressure gauge 534 attached to the separator is simulated with an analog electric meter.

The master cement valve Y1 is either open or closed. This provides total shut-off of the cement rate from the bulk system.

CEMENT CONTROL VALVE P

An empirical model was developed for the cement control valve P from test data which gives the flow rate through the valve as a function of the pressure from the steady flow separator and valve position.

AXIAL FLOW MIXER 516

The axial flow mixer has inputs of cement, water and a recirculated cement/water slurry. This model assumes 100% mixing efficiency. Its output is a mass flow rate to the premix tank.

PREMIX TANK 514 C1

The input to the premix tank is the mass flow rate from the axial flow mixer. On rare occasions, if the wrong valves are opened, there can be flow from either the downhole mix tank or one of the displacement tanks. When the level in the premix tank reaches its weir, the fluid will then flow across the weir into the downhole mix tank. Conservation of mass and continuity equations are used to model this operation.

DOWNHOLE MIX TANK 514 C2

The input to the downhole mix tank is normally fluid coming over the weir from the pre-mix tank. Conservation of mass and continuity equations are used to model this operation. The output is normally to the 6×5 pump or the downhole pumps. The piping model accounts for these and any other abnormal flow condition using conservation of mass and continuity equations.

PIPING

The piping model links all models marked with asterisks in FIGS. 6A and 6B. The piping model uses conservation of mass and continuity equations to model its operation. To keep from having to symbolically solve a 5×5 matrix, one portion of the model was broken into a 3×3 matrix with the three unknowns each being a function of two variables which are a function of the integration of the three unknowns. Since the simulation is to run in real time, initial conditions are selected for the two variables. After solving for the three unknowns using the initial conditions, equations which integrate functions of the three unknowns calculate the two variables. These newly calculated integrated values are then used to calculate the new values of the three unknowns during the next time increment of the simulation. The three unknowns for the FIG. 3 flow diagram are the pressures at nodes 102, 103, and 106. The variables integrated are the flows through nodes 115 and 116. The integration yields the pressures at nodes 115 and 116. These calculated values are then used to determine the pressures at nodes 119 and 120. All other pressures and flows can then be calculated from these values.

Thus, the present invention is well adapted to carry out the objects and attain the ends and advantages mentioned above as well as those inherent therein. While a preferred embodiment of the invention has been described for the purpose of this disclosure, changes in the construction and arrangement of parts and the performance of steps can be made by those skilled in the art, which changes are encompassed within the spirit of this invention as defined by the appended claims.

APPENDIX

ANALOG INPUTS TO SIMULATION COMPUTER

6 × 5 Brannon controller
agitator
4 × 4 Brannon controller
steady flow regulator
left engine throttle
hydraulic engine throttle
lube HT400 regulator
centrifugal pump regulator
cement valve feedback
water valve feedback
snubber for right Martin Decker pressure gauges
snubber for left Martin Decker pressure gauges
manual vent valve on steady flow separator
fill levels for liquid additive tanks

DIGITAL INPUTS TO SIMULATION COMPUTER run/kill left engine
run/kill hydraulic engine
run/kill right engine
recirc densimeter low cal
recirc densimeter operate
recirc densimeter high cal
left transmission neut
left transmission 1st
left transmission 2nd
left transmission 3rd
left transmission 4th
left transmission 5th
centrifugal pump lube
centrifugal pump lube check switch
right transmission neut
right transmission 1st
right transmission 2nd
right transmission 3rd
right transmission 4th
right transmission 5th
lube HT400 valve
lube HT400 check switch
downhole densimeter low cal -continued

APPENDIX downhole densimeter operate
downhole densimeter high cal
mud cup reading - mix tanks
mud cup reading - displacement tanks
measure tank pass side open
measure tank pass side close
measure tank suction side open
measure tank suction side close
measure tank drive side open
measure tank drive side close
master water valve open
master water valve close
recirc line open
recirc line close
downhole recirc open
downhole recirc close
boost line open
boost line close
HT400 suction pass side open
HT400 suction pass side close
HT400 suction open
HT400 suction close
HT400 suction drive side open
HT400 suction drive side close
downhole discharge open
downhole discharge close
tub suction open
tub suction close
premix discharge open
premix discharge close
lo torq v-q open
lo torq v-q close
lo torq v-r open
lo torq v-r close
lo torq v-s open
lo torq v-s close
lo torq v-t open
lo torq v-t close
lo torq v-u open
lo torq v-u close
lo torq v-v open
lo torq v-v close
lo torq v-w open
lo torq v-w close
lo torq v-x open
lo torq v-x close
lap tank #1 right/left switch rt. dump
lap tank #1 dump/fill switch lft. dump
lap tank #2 right/left switch rt. dump
lap tank #2 dump/fill switch lft. dump
auto fill #1
manual fill #1
auto fill #2
manual fill #2
lap tank #3 right/left switch rt. dump
lap tank #3 dump/fill switch lft. dump
lap tank #4 right/left switch rt. dump
lap tank #4 dump/fill switch lft. dump
auto fill #3
manual fill #3
auto fill #4
manual fill #4
digital out cement valve signal
digital out water valve signal
digital out for UNIPRO power
digital out for separator H level
digital out for separator L level
valve A - left side HT400 suction
valve B - right side HT400 suction
valve C - left side to 4 × 4
valve D - right side to 4 × 4
valve E - left side drain
valve F - right side drain
valve M - left side manual fill
valve N - right side manual fill
valve G&H l.s. rel open r. cls.
valve G&H l.s. rel cls. r. open
bulk supply valve on separator
vent line on separator
right side fill valve L
left side fill valve K -continued

APPENDIX right side fill valve J
left side fill valve I
cement master butterfly valve
auto water master butterfly valve
mix paddle
gravity exit - separator
separator to mixer

ANALOG OUTPUTS FROM SIMULATION COMPUTER left engine temperature
left transmission temperature
mud cup
right engine temperature
right transmission temperature
rig air pressure
6 × 5 discharge pressure
4 × 4 discharge presssure
cement valve
water valve
left pressure transducer
right pressure transducer
left Martin Decker gauge
right Martin Decker gauge
Martin Decker chart recorder
right transmission pressure
HT400 lube gauge
pump lube gauge
surge tank pressure gauge
bulk tank weight
water pressure
left engine oil pressure
right engine oil pressure
left transmission pressure

FREQUENCY OUTPUT FROM SIMULATION COMPUTER left engine tachometer
hydraulic engine tachometer
right engine tachometer
left pump rate
right pump rate
mix water rate
downhole densimeter
recirculation densimeter

What is claimed is:

1. A cement mixing and pumping simulator, comprising:

actual cement mixing equipment disposed in a realistic representation of a cement mixing system used in the field for mixing cement for an oil or gas well;

virtual cement mixing equipment means for representing actual operator-actuatable equipment of the cement mixing system, said virtual cement mixing equipment means disposed with said actual cement mixing equipment so that said virtual cement mixing equipment means is physically operable by an operator training on said simulator;

virtual pumping equipment means for representing actual pumping equipment of the cement mixing system; and means, responsive to the operator controlling said actual cement mixing equipment and said virtual cement mixing equipment means and responsive to said virtual pumping equipment means, for generating signals representing operating characteristics of the cement mixing system and for communicating said signals to said actual cement mixing equipment to display to the operator the operating characteristics represented by said signals so that the operator obtains real-time responses to the operator's control of said actual cement mixing equipment and said virtual cement mixing equipment means.

2. A cement mixing and pumping simulator as defined in claim 1, further comprising means for generating and recording data identified with the operator and related to a comparison between at least one of the operating characteristics displayed to the operator and a predetermined response for the same at least one operating characteristic.

3. A cement mixing and pumping simulator as defined in claim 1, wherein:

said actual cement mixing equipment includes an assembly including mixing tank, a plurality of valves, manifolding at least partially connecting said mixing tank and valves, and an operator control stand disposed in said assembly with said mixing tank, said valves and said manifolding; and said virtual cement mixing equipment means includes a plurality of switches mounted on said operator control stand for representing additional valves.

4. A cement mixing and pumping simulator as defined in claim 3, wherein said actual cement mixing equipment further includes another assembly including at least part of a steady flow separator of the cement mixing system.

5. A cement mixing and pumping simulator as defined in claim 4, wherein said virtual cement mixing equipment means further includes variable control means for representing a back pressure control valve of the steady flow separator.

6. A cement mixing and pumping simulator as defined in claim 5, further comprising visual indicator means disposed in said mixing tank for representing to the operator a level of mixture in said tank.

7. A cement mixing and pumping simulator as defined in claim 6, further comprising means for generating and recording data identified with the operator and related to a comparison between at least one of the operating characteristics displayed to the operator and a predetermined response for the same at least one operating characteristic.

8. A cement mixing and pumping simulator as defined in claim 3, further comprising visual indicator means disposed in said mixing tank for representing to the operator a level of mixture in said tank.

9. A method of simulating operation of a cement mixing system, comprising:

operating, at a master control location within actual equipment of a cement mixing system, at least one control device of the cement mixing system;

operating, at the respective location of each, at least one of the actual equipment located away from the master control location;

determining characteristics of material flow through the cement mixing system in response to the operation of the at least one control device and the at least one actual equipment without actually flowing material through the cement mixing system; and displaying the determined characteristics in real time with said operating and determining steps.

10. A method as defined in claim 9, further comprising recording data identifying a performance evaluation of an operator in response to a comparison between at least one of the determined material flow characteristics and a corresponding predetermined

11. A method as defined in claim 9, wherein the actual equipment of the cement mixing system includes an assembly of cement mixing equipment.

12. A method as defined in claim wherein the actual equipment of the cement mixing system further includes an assembly of steady flow separator equipment.

13. A method as defined in claim 9, wherein the actual equipment of the cement mixing system includes an assembly of steady flow separator equipment.

14. A method of simulating operation of a cement mixing system, comprising steps of:

controlling, by an operator at a master control location within an assembly of actual cement mixing equipment, a plurality of control devices at the master control location and generating respective signals indicating the control effected by the operator;

communicating the generated signals to a simulation computer;

controlling, by the operator at respective locations within the assembly of actual cement mixing equipment, actual cement mixing equipment at the respective locations within the assembly and generating other respective signals indicating such control effected by the operator;

communicating such other generated signals to the simulation computer;

generating in the simulation computer, in response to the communicated signals and without actually flowing material through the assembly of actual cement mixing equipment, output signals representing at least one flow characteristic of material thereby simulated to be flowing through the assembly for the respective control by the operator;

displaying, at the assembly and in real time with the foregoing steps and in response to the output signals, the at least one flow characteristic so that the operator is apprised of the material flow obtained in response to the operator's control of the control devices and the actual cement mixing equipment; and repetitively performing the foregoing steps so that the operator continually controls the control devices and the actual cement mixing equipment in response to the displayed at least one characteristic.

15. A method as defined in claim 14, further comprising generating and recording in the simulation computer an evaluation of the operator's control, including comparing in the simulation computer the at least one characteristic with a predetermined standard for the at least one characteristic.

16. A method as defined in claim 14, further comprising:

computing in the simulation computer an amount of a cement slurry; and displaying, in response to the computed amount of cement slurry, in a mixing tank of the actual cement mixing equipment a visual indication simulating a level of cement slurry in the mixing tank so that the operator can actually look in the mixing tank and observe the simulated level of cement slurry.

17. A method as defined in claim 14, wherein controlling the plurality of control devices includes operating a throttle and transmission gearshift for a downhole pump simulated in the simulation computer and operating a simulated back pressure valve for a steady flow separator assembly disposed with the assembly of actual cement mixing equipment.

18. A method as defined in claim 17, further comprising: controlling, by the operator at respective locations within the steady flow separator assembly, actual valves at the respective locations within the steady flow separator assembly and generating still other respective signals indicating such control effected by the operator; and communicating such still other generated signals to the simulation computer.

19. A method of simulating operation of a steady flow separator, comprising:

operating a simulated back pressure valve for an actual steady flow separator assembly;

operating, at their respective locations in the steady flow separator assembly, actual valves of the steady flow separator assembly;

determining, without actually flowing material through the steady flow separator assembly, an amount of material simulated to be in the steady flow separator assembly in response to the operation of the simulated back pressure valve and the actual valves; and displaying in real time at the steady flow separator assembly a visual indication of the simulated amount of material.

20. A method as defined in claim 19, further comprising recording data identifying a performance evaluation of an operator in response to the operator operating the simulated back pressure valve and the actual valves.

* * * * *